United States Patent [19]

Kennard et al.

[11] Patent Number: 4,636,418

[45] Date of Patent: Jan. 13, 1987

[54] CLOTH-LIKE COMPOSITE LAMINATE AND A METHOD OF MAKING

[75] Inventors: Gregory J. Kennard, Shelburne, N.H.; Cedric A. Dunkerly, II, Appleton, Wis.

[73] Assignee: James River Corporation, Richmond, Va.

[21] Appl. No.: 611,151

[22] Filed: May 17, 1984

[51] Int. Cl.[4] ..... B32B 5/12

[52] U.S. Cl. ..... 428/110; 156/306.6; 428/109; 428/249; 428/284; 428/285; 428/287; 428/326; 428/342

[58] Field of Search ..... 428/109, 110, 111, 195, 428/196, 198, 219, 247, 248, 249, 284, 285, 286, 287, 298, 299, 326, 913; 156/62.2, 278, 276, 279, 280, 324, 306.6

[56] References Cited

U.S. PATENT DOCUMENTS

| | | | |
|---|---|---|---|
| 2,543,101 | 2/1951 | Francis, Jr. | 428/284 |
| 2,841,202 | 7/1958 | Hirschy | 428/247 |
| 2,902,395 | 9/1959 | Hirschy et al. | 428/110 |
| 3,341,394 | 9/1967 | Kinney | 428/296 |
| 3,485,706 | 12/1968 | Evans | 161/72 |
| 3,502,538 | 3/1970 | Petersen | 161/150 |
| 3,575,749 | 10/1970 | Kroyer | 156/62.2 |
| 3,629,047 | 12/1971 | Davison | 428/249 |
| 3,652,374 | 3/1972 | Condon | 161/57 |
| 3,692,622 | 9/1972 | Dunning | 161/124 |
| 3,708,383 | 1/1973 | Thomas et al. | 161/57 |
| 3,709,764 | 1/1973 | Thomas | 161/57 |
| 3,726,750 | 4/1973 | Stillings | 161/57 |
| 3,753,844 | 8/1973 | Braun | 161/57 |
| 3,755,028 | 8/1973 | Wood | 156/62.2 |
| 3,756,913 | 9/1973 | Wodka | 162/183 |
| 3,765,997 | 9/1973 | Dunning | 156/62.2 |
| 3,769,115 | 9/1973 | Rasmussen et al. | 156/62.2 |
| 3,770,562 | 11/1973 | Newman | 161/156 |
| 3,794,537 | 2/1974 | Rahmes | 156/62.8 |
| 3,809,604 | 5/1974 | Estes | 162/100 |
| 3,837,999 | 9/1974 | Chung | 162/101 |
| 3,885,279 | 5/1975 | Darnell et al. | 156/439 |
| 3,895,089 | 7/1975 | Goyal | 264/89 |
| 3,963,392 | 6/1976 | Goyal | 425/83 |
| 4,036,679 | 7/1977 | Back et al. | 162/9 |
| 4,049,491 | 9/1977 | Brandon et al. | 162/101 |
| 4,071,651 | 1/1978 | Hicklin et al. | 428/284 |
| 4,081,582 | 3/1978 | Butterworth et al. | 428/284 |
| 4,082,886 | 4/1978 | Butterworth et al. | 478/284 |
| 4,100,324 | 7/1978 | Anderson et al. | 428/288 |
| 4,152,479 | 5/1979 | Larsen | 428/224 |
| 4,154,883 | 5/1979 | Elias | 428/171 |
| 4,193,751 | 3/1980 | Miller | 425/83.1 |
| 4,196,245 | 4/1980 | Kitson et al. | 428/198 |
| 4,198,460 | 4/1980 | Kiss | 428/284 |
| 4,239,792 | 12/1980 | Ludwa | 128/156 |
| 4,264,290 | 4/1981 | Bunkerly, II | 264/121 |
| 4,284,680 | 8/1981 | Awano et al. | 418/234 |
| 4,285,647 | 8/1981 | Dunkerly, II | 19/296 |
| 4,292,271 | 9/1981 | Boub et al. | 264/518 |

*Primary Examiner*—James J. Bell

*Attorney, Agent, or Firm*—Finnegan, Henderson, Farabow, Garrett & Dunner

[57] ABSTRACT

A method of making a cloth-like composite laminate is provided. The method includes the steps of air laying a continuous layer of three-dimensional cellulosic fibers one side of a layer of nonwoven material; applying to the continuous layer of three-dimensional cellulosic fibers and the nonwoven material layer a latex adhesive containing a wetting agent; and drying the latex adhesive and wetting agent to bind the layer of cellulosic fibers to the nonwoven material layer to form a cloth-like composite laminate having a continuous layer of three-dimensional cellulosic fibers bound to one side of the nonwoven material layer.

30 Claims, 4 Drawing Figures

CLOTH-LIKE COMPOSITE LAMINATE AND A METHOD OF MAKING

FIELD OF THE INVENTION

The present invention relates to air laid fibrous webs and, more particularly, to a cloth-like composite laminate of cellulosic fibers.

BACKGROUND OF THE INVENTION

Air laid technology is used to form a variety of cellulosic paper products. It is usually desirable that cellulosic composite laminates exhibit a number of qualities such as a cloth-like appearance, excellent wet and dry strength, exceptional porosity, very good abrasion resistance and wash durability, and a lack of a paper rattle. Cellulosic composite laminates that possess these qualities can be used to make towels or tissues that are valuable assets in the performance of a variety of tasks. For example, such a towel or tissue can be used by doctors and nurses as a highly effective and strong hand towel or tissue in both a hospital and an office.

Similarly, it is desirable to form a cellulosic composite laminate having two diverse sides of unique qualities. This construction would permit each side of the composite laminate to contain a specific property for a distinct use. Consequently, one towel or tissue made of such a composite laminate could perform the function of two previously separate towels or tissues.

Previous processes and cellulosic composite laminates fail to provide one or more of these desirable qualities. For example, previous towels or tissues made of cellulosic composite laminates have two similar external sides of like properties. These towels or tissues do not have the desired cloth-like appearance, and lack the proper wet and dry strength that is needed in a variety of uses.

SUMMARY OF THE INVENTION

The present invention provides a cloth-like composite laminate of a superior balance of properties, such as strength, cloth-like appearance, abrasion resistance, wash durability, and porosity.

Another feature of the present invention is the provision of a cloth-like composite laminate having two sides of diverse properties.

Additional advantages of the invention will be set forth in the description that follows, and in part will be obvious from the description, or may be learned by practice of the invention. The advantages of the invention are realized and obtained by the process and combinations particulary pointed out in the appended claims.

The present invention provides a method of making a cloth-like composite laminate comprising the steps of: air laying a continuous layer of three-dimensional cellulosic fibers onto one side of a layer of nonwoven material; applying to the continuous layer of three-dimensional cellulosic fibers and the nonwoven material layer a latex adhesive containing a wetting agent; and drying the latex adhesive and wetting agent to bind the layer of cellulosic fibers to the non-woven material layer to form a cloth-like composite laminate having a continuous layer of three-dimensional cellulosic fibers bound to one side of the nonwoven material layer.

The present invention also provides a cloth-like composite laminate comprising: a nonwoven material layer, an air laid continuous layer of three-dimensional cellulosic fibers positioned on one side of the nonwoven material layer, and a latex adhesive containing a wetting agent binding the air laid continuous layer to the nonwoven material layer.

The present invention overcomes the inherent disadvantages of previous cellulosic composite laminates and obtains the various advantages of the invention. The cellulosic composite laminates of the present invention exhibit high wet and dry strength properties, and exceptional porosity. Towels or tissues made from the composite laminates appear cloth-like, and have excellent abrasion resistance and wash durability. The towels or tissues lack the noisy paper rattle that is commonly associated with most cellulosic products.

The cloth-like composite laminate, in one embodiment, possesses two different sides of unique properties. For example, the cloth-like composite laminate can have both a smooth surface and a rough surface. This allows the user of a towel or tissue made from the composite laminate to perform two diverse tasks with the same towel or tissue. Such a multi-functional towel or tissue saves the time, effort, and expense needed to obtain and use two separate towels or tissues.

When the nonwoven material layer is a scrim an intimate intermingling occurs between the cellulosic fibers and the scrim. The cellulosic fibers become entangled within the holes of the scrim to enhance the bond between the scrim and the nonwoven material layer.

The foregoing and other features and advantages of the present invention will be made more apparent from the following description of the preferred embodiments.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE PREFERRED EMBODIMENT

Figure 3:
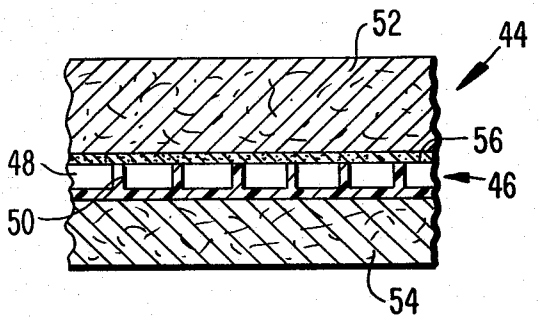
FIG. 3 is a cross section through a cloth-like composite laminate of an alternative embodiment of the present invention using a scrim.

Reference will now be made in detail to the present preferred embodiments of the invention, embodiments of which are illustrated in the accompanying drawings.

The method of the invention produces a cloth-like composite laminate. The initial step of the method is the air laying of a continuous layer of three-dimensional cellulosic fibers onto one side of a nonwoven material layer. A latex adhesive containing a wetting agent is then applied to the continuous layer of three-dimensional cellulosic fibers and the nonwoven material layer. The latex adhesive and wetting agent are subsequently dried to bind the layers together and form a cloth-like composite laminate having a continuous layer of three-dimensional cellulosic fibers bound to one side of the nonwoven material layer.

The three-dimensional cellulosic fibers are preferably wood pulp fibers, and most preferably twisted wood pulp fibers. Preferably, the wood pulp fibers are chemically treated and predried to obtain a 90 to 95% solids content. Examples of wood pulp fibers include cedar fibers, southern pine fibers, spruce fibers, hemlock fibers and other common chemical pulp fibers. Suitable three dimensional and twisted fibers are prepared by various techniques such as those described in U.S. Pat. Nos. 4,036,679 to Back 3,809,604 to Estes, and 3,756,913 to Wodka. The particular fibers used depend upon the type of texture, such as soft, wooly, or fluffy, that is required.

Suitable dimensions for the fibers include lengths of from 0.5 millimeters to 5 millimeters, and thicknesses of from 1 micron to 6 microns. The weight of the cellulosic fibers that are air laid onto the nonwoven material layer is within the range of 5 pounds per ream to 60 pounds per ream and, preferably, within the range of 15 pounds per ream to 40 pounds per ream.

The nonwoven material layer can be composed of a variety of nonwoven materials, such as nylon, rayon, polyester, polypropylene, glass, and aramids such as Kevlar and Nomex which are trademarks of the E. I. DuPont de Nemours & Co. An example of a bonded polyester nonwoven material is Bayex, which is a trademark of Bay Mills, Ltd.

The nonwoven material can be bonded by a variety of techniques such as spin bonding or latex saturating, or they can be wet formed. The weight of the nonwoven material is within the range of 0.2 ounces per square yard to 3 ounces per square yard and, preferably, within the range of 0.3 ounces per square yard to 1 ounce per square yard.

The latex adhesive, used to bind the continuous layer of cellulosic fibers onto the nonwoven material layer, can be selected from various latex adhesives known in the art. Acceptable latex adhesives include acrylate emulsions, butadiene-styrene emulsions, acetate-ethylene emulsions, and acrylonitrile-butadiene emulsions. An especially effective latex adhesive is acetate-ethylene, which is sold under the trademark Airflex A-106 by Air Products, Inc. of Allentown, Pa.

A wetting agent or surfactant is included in the latex adhesive to promote the bond between the continuous layer of cellulosic fibers and the nonwoven material layer. The wetting agent or surfactant is selected to be compatible with the latex adhesive, the cellulosic fibers, and the nonwoven material layer being used for a particular composite laminate. Suitable wetting agents or surfactants include nonionic surfactants such as polyoxyalkylene derivatives of propylene glycol sold under the trademark Pluronics by BASF Wyandot, and polyoxyalkylene derivatives of ethylenediamine sold under the trademark Tetronix by BASF Wyandot.

The skilled artisan can select the particular latex adhesive and wetting agent depending upon the type of cellulosic fibers and the nonwoven material that are to be bound. The latex adhesive and wetting agent is applied by known techniques, such as spraying or foaming.

The amount of solids deposited from the latex adhesive used depends, inter alia, on the weight of fiber deposited on the nonwoven. The amount of wetting agent utilized is usually from about 0.1 to 1.5 percent of the weight of the latex adhesive including its water content. Generally latex adhesives of from 15% to 25% solids are used. A key to good bonding between the layers is the incorporation of the proper wetting agent in the latex adhesive.

After the continuous layer of three-dimensional cellulosic fibers is bound to the nonwoven material layer, the latex adhesive and the wetting agent are dried by conventional techniques to bind the layer of a cellulosic fibers to the nonwoven material layer. As a result, a cloth-like composite laminate, having a continuous layer of three-dimensional cellulosic fibers, is produced.

Figure 1:
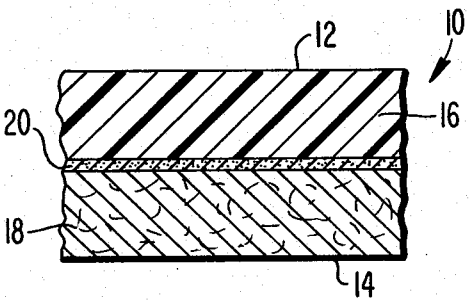
FIG. 1 is a cross section through a cloth-like composite laminate of the present invention having one continuous layer of cellulosic fibers.

This cloth-like composite laminate 10 has, as shown in FIG. 1, two diverse external sides 12 and 14 of different properties. For example, the external side 12 of the nonwoven material layer 16 of the composite laminate 10 can be smooth, while the external side 14 of the cellulosic fiber continuous layer 18 is relatively rough. The adhesive and wetting agent 20 lies between the nonwoven material layer 16 and the cellulosic fiber continuous layer 18. The cellulosic fibers in the continuous layer 18 can have their fibers bound together, as well as being bound to the nonwoven material layer 16.

In another embodiment, the nonwoven material layer is initially pre-treated with a latex adhesive and wetting agent prior to air laying a continuous layer of cellulosic fibers onto one side of the nonwoven material layer. The latex adhesive and wetting agent are dried to bond the layer of cellulosic fibers to one side of the nonwoven material layer.

After one side of the nonwoven material layer has been bound to the continuous layer of cellulosic fibers, a second continuous layer of three-dimensional cellulosic fibers is air laid onto a second side of the nonwoven material layer. A latex adhesive with a wetting agent is applied to the second continuous layer of three-dimensional cellulosic fibers and the nonwoven material layer. The latex adhesive and wetting agent are dried to bind the second continuoues layer to form a cloth-like composite laminate. The latex adhesive and wetting agent useful in this embodiment can be selected from the above noted latex adhesives and wetting agents.

Figure 2:
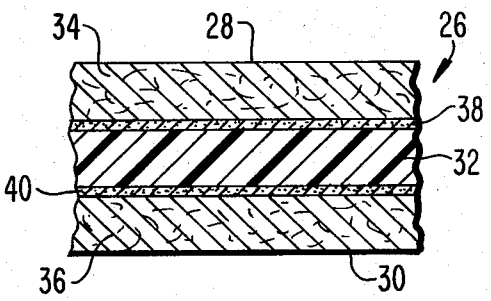
FIG. 2 is a cross section through a cloth-like composite laminate of an alternative embodiment of the present invention having two continuous layers of cellulosic fibers.

The resulting cloth-like composite laminate 26, as shown in FIG. 2, has two similar external sides 28 and 30 of homogenous properties. The nonwoven material layer 32 is bound to the two cellulosic fiber continuous layers 34 and 36. Adhesive layers 38 and 40, on both sides of the nonwoven material layer 32, bind the cellulosic fiber continuous layers 34 and 36 to opposite sides of the nonwoven material layer 32.

In another embodiment shown in FIG. 3, the cloth-like composite laminate 44 uses as a nonwoven material layer 46 a scrim 48 having a plurality of holes 50 for receiving and reinforcing the cellulosic fibers that are air laid upon the scrim 48. The holes 50 allow all of the various cellulosic fibers forming the cellulosic fiber continuous layer 52 and 54 to interact to result in a nearly homogenous composite laminate 44 that is interrupted only by scrim lines 56. The resulting composite laminate 44 has a three-dimensional intimate contact between the cellulosic fibers, the latex adhesive, and the scrim in the holes 50 of the scrim 48.

The scrim can have a set of spaced one-direction threads with a second set of spaced threads lying cross-directionally with respect to the first set of threads. The two sets of threads are bound or adhered together at the points the threads of one set cross the threads of another set. The threads making up the scrim can be in an over and under configuration, as shown in U.S. Pat. No. 3,885,279 to Darnell et al. or a one side-pattern as shown in U.S. Pat. No. 2,902,395 to Hirschy et al. Other scrim configurations known in the art, such as extended netting described in U.S. Pat. No. 4,152,479 to Larsen, can also be used.

The cloth-like composite laminates of the present invention exhibit high wet and dry strength properties, and exceptional porosity. Towels or tissues manufactured from these composite laminates have a cloth-like appearance, excellent abrasion resistance, and excellent wash durability. The towels or tissues additionally lack the noisy paper rattle that is commonly associated with most paper products.

Figure 4:
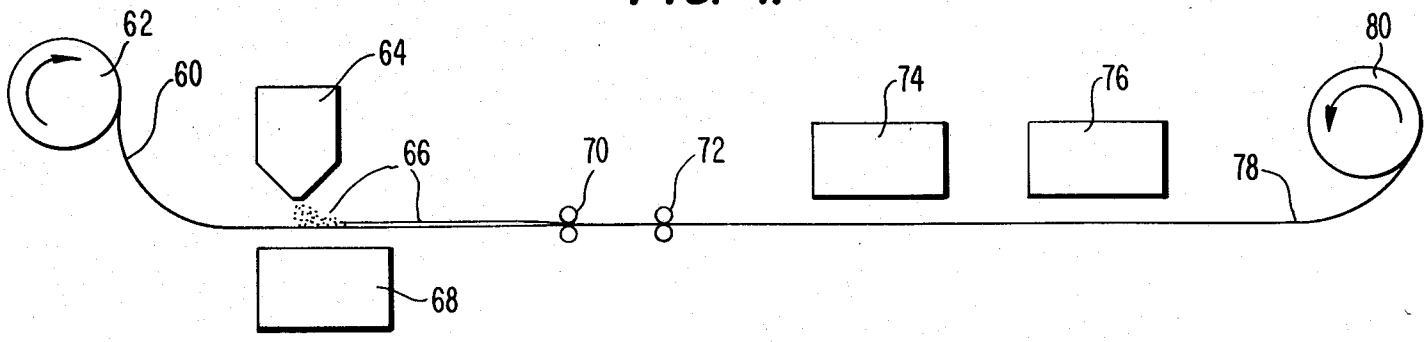
FIG. 4 is a schematic diagram depicting the apparatus used in the method of the present invention.

The method of the present invention can be performed by various apparatus known in the art. In one example, as shown in FIG. 4, a nonwoven material layer 60 is unwound from a supply roll 62. An air laying station 64 distributes a continuous layer 66 of three-dimensional cellulosic fibers onto one side of the nonwoven material layer 60. A suction box 68 is located below the nonwoven material layer 60, as the cellulosic fibers are distributed, to arrange the cellulosic fibers on the nonwoven material layer 60. Acceptable air laying stations 64 and suction boxes 68 are shown in U.S. Pat. Nos. 4,264,290 and 4,285,647 to Dunkerly, II.

The nonwoven material layer 60 and the continuous cellulosic fiber layer 66 are advanced through heated compacting rolls 70 and embossing nip 72 to an application station 74. In the application station 74, a latex adhesive and a wetting agent are dispensed onto the advancing nonwoven material layer 60 and the cellulosic fiber layer 66. One or more drying stations 76 then dry the latex adhesive and the wetting agent to bind the cellulosic fiber layer 66 to the nonwoven material layer 60 to form the cloth-like composite laminate 78, which is collected on a reel 80.

Other embodiments of the invention will be apparent to one skilled in the art from a consideration of the specification or the practice of the invention disclosed herein. It is intended that the specification be considered as exemplary only with the true scope and spirit of the invention being indicated by the claims.

What is claimed is:

1. A method of making a cloth-like composite laminate comprising the steps of:

(a) air laying a continuous layer of three-dimensional cellulosic fibers onto one side of a layer of nonwoven material;

(b) applying to the continuous layer of three-dimensional cellulosic fibers and the nonwoven material layer a latex adhesive containing a wetting agent; and (c) drying the latex adhesive and wetting agent to bond the layer of cellulosic fiber to the non-woven material layer to form a cloth-like composite laminate having substantially all of a continuous layer of three-dimensional cellulosic fibers bound to one side of the nonwoven material layer.

2. The method of claim 1, wherein the cellulosic fibers are wood pulp fibers.

3. The method of claim 2, wherein the wood pulp fibers are selected from mechanical pulp fibers and chemical pulp fibers.

4. The method of claim 2, wherein the wood pulp fibers are selected from the group consisting of cedar fibers, southern pine fibers, spruce fibers, and hemlock fibers.

5. The material of claim 2, wherein the wood pulp fibers are twisted.

6. The method of claim 1, wherein the weight of the cellulosic fibers air laid onto the nonwoven material layer is within the range of 5 pound per ream to 50 pounds per ream.

7. The method of claim 1, wherein the weight of the cellulosic fibers air laid onto the nonwoven material layer is within the range of 15 pounds per ream to 40 pounds per ream.

8. The method of claim 1, wherein the nonwoven material is selected from the group consisting of nylon, rayon, polyester, polypropylene, glass, and aramids.

9. The method of claim 1, wherein the weight of the nonwoven material is within the range of 0.2 ounces per square yard to 3 ounces per square yard.

10. The method of claim 1, wherein the weight of the nonwoven material is within the range of 0.3 ounces per square yard to 1 ounce per square yard.

11. The method of claim 1, wherein the latex application step is performed by spraying the latex adhesive and the wetting agent on the continuous layer of cellulosic fibers.

12. The method of claim 1, wherein the latex application step is performed by foaming the latex adhesive and the wetting agent on the continuous layer of cellulosic fibers.

13. The method of claim 1, wherein the latex adhesive is selected from the group consisting of acrylate emulsions, butadiene-styrene emulsions, acetate-ethylene emulsions, and acrylonitrile-butadiene emulsions.

14. The method of claim 1, wherein the three-dimensional cellulosic fibers in the continuous layer are interfiber bound together.

15. A method of making a cloth-like composite laminate comprising the steps of:

(a) pre-treating a nonwoven material layer with a latex adhesive and wetting agent;

(b) air laying a continuous layer of three-dimensional cellulosic fibers onto one side of the nonwoven material layer;

(c) drying the latex adhesive and wetting agent to bond substantially all of the layer cellulosic fibers to one side of the nonwoven material layer;

(d) air laying a second continuous layer of cellulosic fibers to a second side of the nonwoven material layer;

(e) applying to the second continuous layer of three-dimensional cellulosic fibers and the nonwoven material layer a latex adhesive containing a wetting agent; and (f) drying the latex adhesive and wetting agent to bind substantially all of the second continuous layer to the second side of the non-woven material layer to form a cloth-like composite laminate having two continuous layers of three-dimensional cellulosic fibers bound to opposite sides of the nonwoven material layer.

16. The method of claim 15, wherein the nonwoven material is a scrim having a plurality of holes for receiving the cellulosic fibers.

17. A cloth-like composite laminate comprising:

(a) a nonwoven material layer;

(b) an air laid continuous layer of three-dimensional cellulosic fibers positioned on one side of the nonwoven material layer; and (c) a latex adhesive containing a wetting agent binding substantially all of the air laid continuous layer to the nonwoven material layer.

18. The cloth-like composite laminate of claim 17, wherein the cellulosic fibers are wood pulp fibers.

19. The cloth-like composite laminate of claim 18, wherein the wood pulp fibers are selected from mechanical pulp fibers and chemical pulp fibers.

20. The cloth-like composite laminate of claim 18, wherein the wood pulp fibers are selected from the group consisting of cedar fibers, southern pine fibers, spruce fibers and hemlock fibers.

21. The cloth-like composite laminate of claim 18, wherein the wood pulp fibers are twisted.

22. The cloth-like composite laminate of claim 17, wherein the nonwoven material is selected from the group consisting of nylon, rayon, polyester, polypropylene, glass, and aramids.

23. The cloth-like composite laminate of claim 17, wherein the weight of the cellulosic fibers is within the range of 15 pounds per ream to 40 pounds per ream.

24. The cloth-like composite laminate of claim 17, wherein the weight of the nonwoven material layer is within the range of 0.2 ounce per square yard to 3 ounces per square yard.

25. The cloth-like composite laminate of claim 17, wherein the weight of the nonwoven material layer is within the range of 0.3 ounces per square yard to 1 ounce per square yard.

26. The cloth-like composite laminate of claim 17, wherein the cellulosic fibers are interfiber bound together.

27. The cloth-like composite laminate of claim 17, wherein the latex adhesive is selected from the group consisting of acrylate emulsions, butadiene-styrene emulsions, acetate-ethylene emulsions, and acrylonitrile-butadiene emulsions.

28. The cloth-like composite laminate of claim 17, wherein the nonwoven material layer and the cellulosic fiber layer have diverse properties.

29. The cloth-like composite laminate of claim 17, further comprising:

a second air laid continuous layer of three-dimensional cellulosic fibers positioned on a second side of the nonwoven material layer; and a latex adhesive containing a wetting agent binding substantially all of the second air laid continuous layer to the nonwoven material layer.

30. The cloth-like composite laminate of claim 17, wherein the nonwoven material layer is a scrim.

* * * * *